United States Patent [19]

Anderson

[11] 4,008,969

[45] Feb. 22, 1977

[54] WRITING INSTRUMENT TOP

[75] Inventor: Olof Verner Anderson, North Kingstown, R.I.

[73] Assignee: Anson Incorporated, Providence, R.I.

[22] Filed: Oct. 22, 1975

[21] Appl. No.: 624,662

Related U.S. Application Data

[63] Continuation-in-part of Ser. No. 480,005, June 17, 1974.

[52] U.S. Cl. ..... 401/292; 29/518

[51] Int. Cl.[2] ..... B43K 9/00

[58] Field of Search ..... 401/194, 98, 124, 213, 401/243–247, 262, 269; 40/334; 29/515, 518; 403/280

[56] References Cited

UNITED STATES PATENTS

| | | | |
|---|---|---|---|
| 1,514,002 | 11/1924 | Kraker | 401/194 X |
| 2,272,139 | 2/1942 | Tapner | 40/334 |

FOREIGN PATENTS OR APPLICATIONS

| | | | |
|---|---|---|---|
| 13,900 | 6/1907 | United Kingdom | 401/194 |
| 781,594 | 2/1935 | France | 40/334 |

*Primary Examiner*—Lawrence Charles
*Attorney, Agent, or Firm*—William Frederick Werner

[57] ABSTRACT

The present disclosure relates to writing instrument tops as an article of manufacture and specifically to an improved construction and the method of making the same.

2 Claims, 10 Drawing Figures

WRITING INSTRUMENT TOP

The present invention is a continuation-in-part of United States Pat. application Ser. No. 480,005 filed June 17, 1974 for a Writing Instrument Top.

STATEMENT OF INVENTION

The present invention relates to a novel construction and a new esthetic appearance in writing instrument tops and the method of making the same.

BACKGROUND OF THE INVENTION

Mechanical writing instruments of the propel-repel type comprise two inter-related tubes. One tube provided with the writing end is termed the body. The other tube removably secured to the body is termed, the top. The propel-repel mechanism may be located in the body or in the top. In either event, the lower end of the body tube is provided with the writing element which provides a closure member for the lower end of the body tube. The upper end of the body tube is normally left open and is constructed so as to removably secure the top to the body.

The lower end of the top tube is open and adapted to cooperate with the open upper end of the body tube so as to be removably secured thereto.

There has always remained a problem of what to do with the open upper end of the top tube. In some instances the top end is swedged over to close the top. In other instances, structures were built on to the top to provide fluid seals against ink leakage or to provide a fanciful end.

The mechanical writing instrument, when the body and top are fabricated from sterling silver or gold-rolled or gold-filled attached to a base metal is classed as an article of jewelry. The top must therefore present an esthetic appearance to provide sales appeal and a price beyond that of a lead pencil or inexpensive ball point pen.

Various types of plugs and configurations have been provided to close the top end of the top. Such plugs and configurations have then been used as symbols to indicate the source of manufacture and thereby have become trade marks. No consideration was given to the personality of the individual who ultimately purchased the article of jewelry for personal use.

In the prior application the ornament was held in the top end of the top by means of a shelf and a tapered side on the ornament so that a swedging action would taper the end of the top against the tapered side to provide a securing means. It seems that many people dropped the writing instrument or taped the top against a desk. Such action dislodged the ornament due to the delicate wall thinness of the top at the tapered section.

OBJECTS OF THE INVENTION

It is, therefore, an object of the present invention to fortify the end of the top without destroying the structural features which exemplify the personality of the purchaser.

Another object of the present invention is to provide a new writing instrument top construction and the method of providing the same.

Other objects of the present invention will become apparent in part and be pointed out in part in the following specification and claims.

BRIEF DESCRIPTION OF THE DRAWINGS

Like reference numerals refer to like parts in the following drawings in which.

DESCRIPTION OF THE PREFERRED EMBODIMENTS

It is pointed out that the top (and body) are of a fragile nature due to their fabrication from precious metal and also due to the fact that a writing instrument must be very light in weight in spite of the propel-repel mechanism located within the body and/or top. The thickness of the tube constituting the top must be very thin in order to be very light in weight.

Figure 1:
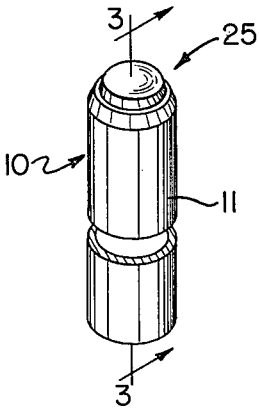
FIG. 1 is a perspective view of the new and improved writing instrument top.
Figure 3:
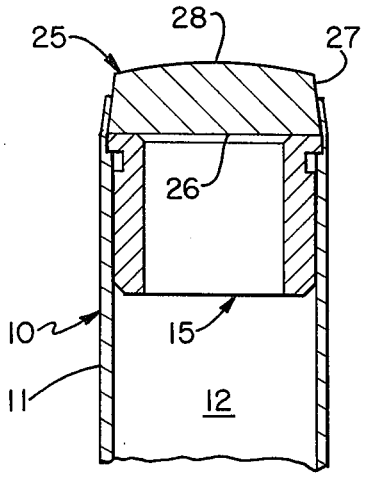
FIG. 3 is a fragmentary cross sectional view taken on line 3—3 of FIG. 1, showing an ornament fastened within the upper opening of the top.
Figure 4:
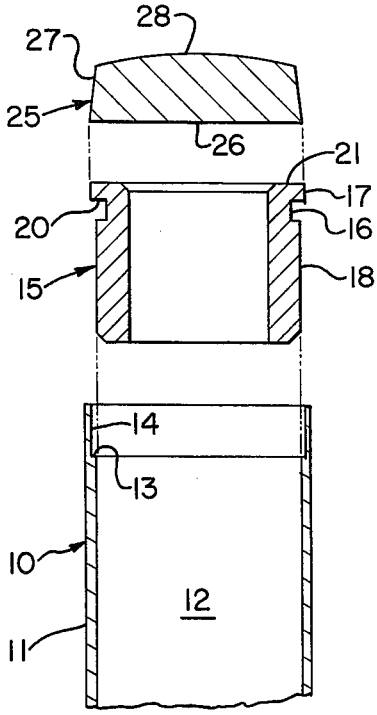
FIG. 4 is an exploded view showing the several parts which form the assembly shown in FIG. 3.
Figure 5:
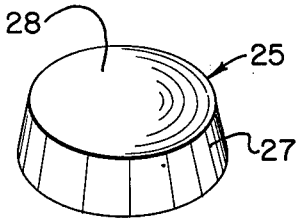
FIG. 5 is a perspective view of one type of ornament termed a gem stone.
Figure 2:
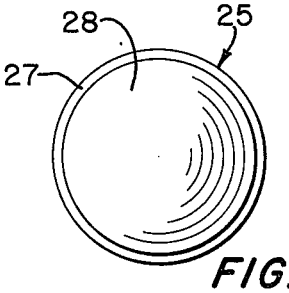
FIG. 2 is a top plan view of FIG. 1.
Figure 6:
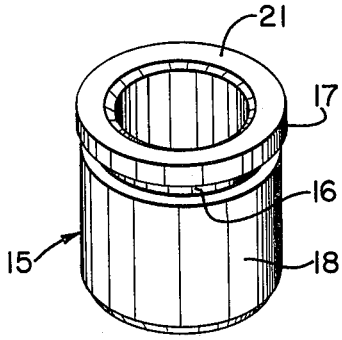
FIG. 6 is a perspective view of the new and improved insert.

Reference is made to FIGS. 1 through 6 wherein is illustrated a tube 10 having a thin wall 11 and an axial passageway 12. A counterbore 14 is made in the open upper end of the tube 10 in wall 11 to provide a shelf 13.

A ferrule (by definition a short tube or bushing for tightening a joint), generally indicated by reference numeral 15, is provided with a circular recess 16 which separates a primary surface 17 from a smaller secondary surface 18. The primary surface 17 forms a ledge 20 at circular recess 16 in cooperation with said smaller secondary surface 18.

Secondary surface 18 is of a size approximately equal to the diameter of axial passageway 12, so that when ferrule 15 is passed into axial passageway 12 secondary surface 18 engages wall 11 with a "push fit" and ledge 20 engages shelf 13.

An ornament, generally indicated by reference numeral 25, has a bottom 26 and a side 27 provided with an approximate 5° taper. Ornament 25 is placed in said counterbore 14 with bottom 26 engaging the top 21 of ferrule 15. That portion of wall 11 above shelf 13 is spun against tapered side 27 to deform the wall against the tapered side. The word deformed is defined as changing of form or shape as by stress. In this manner, ornament 25 is fastened in the top of axial passageway 12 with ferrule 15 re-enforcing wall 11 and supporting ornament 25.

The top 28 of ornament 25 may be crowned or have a selected configuration as esthetic conditions dictate. Ornament 15 may be a precious stone, a birth stone, a fraternity, society or religious insignia or a mere closure member of any selected configuration.

Figure 7:
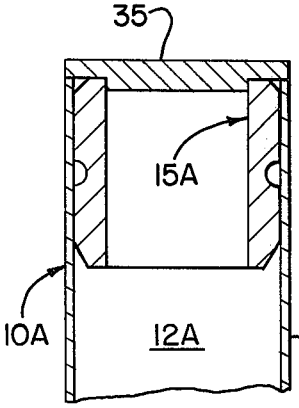
FIG. 7 is a fragmentary cross sectional view showing a modified form of construction to that shown in FIG. 3.
Figure 8:
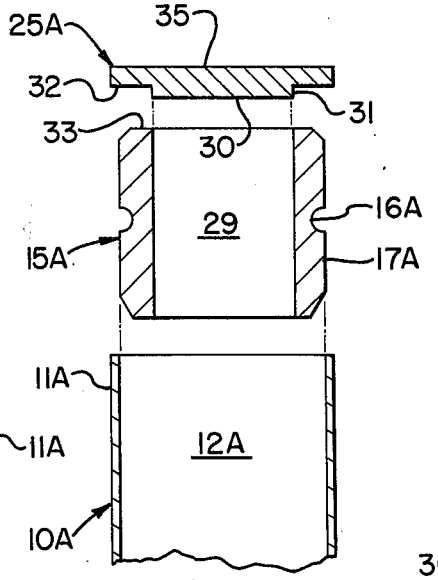
FIG. 8 is an exploded view, showing the several parts which form the assembly shown in FIG. 7.
Figure 10:
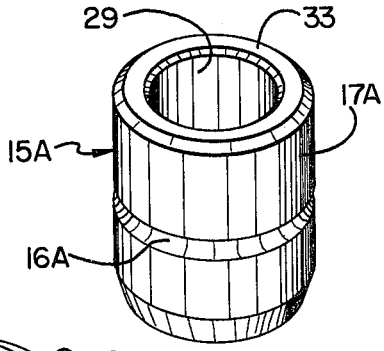
FIG. 10 is a perspective view of a modified form of insert.
Figure 9:
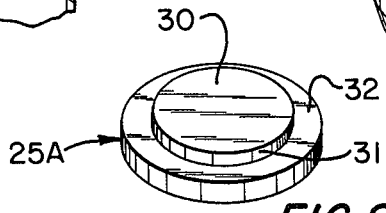
FIG. 9 is a perspective view of another type of ornament.

Reference is now made to FIGS. 7 through 10 of the drawings. A tube, generally indicated at 10A is provided with an axial passageway 12A and a wall 11A.

A ferrule, generally indicated by reference numeral 15A, is provided with a circular recess 16A, an outside surface 17A, a top surface 33, and a bore 29. A cap, generally indicated by reference numeral 25A, is provided with a circular projection 30 having a side 31 and a ledge 32. The circular projection 30 is inserted into bore 29 with ledge 32 engaging top surface 33. Cap 25A is fastened to ferrule 15A as by means of welding or soldering. Ferrule 15A is inserted into axial passageway 12A with ledge 32 engaging the outer edge of tube 10A. Outside surface 17A engages wall 11A with a press fit. In this manner, ferrule 15A re-enforces the wall 11A while retaining ferrule 15A and cap 25A in position in axial passageway 12A.

The top surface 35 of cap 25A may be engraved with insignia or be an ornamental closure for tube 10A.

Having shown and described preferred embodiments of the present invention by way of example, it should be realized that structural changes could be made and other examples given without departing from either the spirit or scope of this invention.

What I claim is:

1. A writing instrument top consisting of a tube having a wall and an axial passageway, a counterbore in said wall providing a shelf in one end of said tube, a ferrule having a primary surface and a smaller secondary surface, a recess separating said primary surface from said smaller secondary surface, a ledge formed at the juncture of said recess with said primary surface and in cooperation with said smaller secondary surface, said ferrule positioned in said axial passageway with said ledge engaging said shelf and said smaller secondary surface engaging said wall to re-enforce said wall, an ornament having a bottom and a side provided with a taper, said ornament positioned in said counterbore with said bottom engaging said ferrule, and said wall deformed against said side provided with a taper to secure said ornament in said counterbore and against said ferrule.

2. In the manufacture of a writing instrument top, the method comprising the steps of:

a. selecting a tube having a wall and an axial passageway, b. counterboring said wall in one end of said tube to provide a shelf, c. providing a ferrule with a primary surface and a smaller secondary surface, separated by a recess forming a ledge on said primary surface in cooperation with said secondary surface, d. selecting an ornament having a bottom and a side having a taper, e. inserting said ferrule into said axial passageway with said ledge engaging said shelf and said secondary surface engaging to re-enforce said wall, f. inserting said ornament into said counterpore with said bottom engaging said ferrule, g. spinning said wall adjacent said counterbore to engage said wall with said side having a taper, to fasten said ornament in said counterbore and against said ferrule.

* * * * *